US006637401B1

(12) United States Patent
Nozue

(10) Patent No.: US 6,637,401 B1
(45) Date of Patent: Oct. 28, 2003

(54) VALVE DRIVE MECHANISM FOR OUTBOARD MOTOR

(75) Inventor: Toshihiro Nozue, Hamamatsu (JP)

(73) Assignee: Yamaha Marine Kabushiki Kaisha, Shizuoka (JP)

( * ) Notice: Subject to any disclaimer, the term of this patent is extended or adjusted under 35 U.S.C. 154(b) by 0 days.

(21) Appl. No.: 09/659,971

(22) Filed: Sep. 12, 2000

(30) Foreign Application Priority Data

Sep. 16, 1999 (JP) ..... 11-262481

(51) Int. Cl.[7] ..... F01L 1/02
(52) U.S. Cl. ..... 123/198 R; 123/90.31
(58) Field of Search ..... 123/198 R, 90.31, 123/406.58

(56) References Cited

U.S. PATENT DOCUMENTS

| | | | | |
|---|---|---|---|---|
| 4,230,074 A | | 10/1980 | Ichikawa et al. | |
| 4,333,433 A | * | 6/1982 | Mattson | 123/406.58 |
| 4,643,143 A | | 2/1987 | Uchiyama et al. | |
| 5,184,582 A | | 2/1993 | Okui et al. | |
| 5,425,336 A | * | 6/1995 | Nakayama | 123/198 R |
| 5,489,243 A | * | 2/1996 | Watanabe | 123/90.31 |
| 5,564,380 A | | 10/1996 | Kobayashi et al. | |
| 5,704,819 A | | 1/1998 | Isogawa | |
| 5,724,936 A | * | 3/1998 | Osakabe | 123/198 R |
| 5,752,866 A | | 5/1998 | Takahashi et al. | |
| 5,755,606 A | | 5/1998 | Takahashi et al. | |
| 5,765,519 A | | 6/1998 | Watanabe | |
| 5,865,655 A | * | 2/1999 | Hiraoka et al. | 123/90.31 |
| 5,873,755 A | | 2/1999 | Takahashi et al. | |
| 6,032,628 A | * | 3/2000 | Watanabe et al. | 123/90.31 |
| 6,044,817 A | * | 4/2000 | Hiraoka et al. | 123/198 R |
| 6,070,564 A | * | 6/2000 | Hiraoka et al. | 123/198 R |

OTHER PUBLICATIONS

US 5,848,578, 12/1998, Uchiyama et al. (withdrawn)*

* cited by examiner

*Primary Examiner*—Henry C. Yuen
*Assistant Examiner*—Jason Benton
(74) *Attorney, Agent, or Firm*—Knobbe, Martens, Olson & Bear, LLP.

(57) ABSTRACT

An engine has a crankshaft. The crankshaft has a set of steps formed at one end. A drive pulley for a cam drive arrangement is positioned on one of the steps. A set of holes are formed in the end of the crankshaft adjacent to the steps. The holes has axes that are substantially parallel with a rotational axis of the crankshaft. Threaded fasteners that screw into the holes couple the crankshaft and the drive pulley. An alignment pin also extends between the drive pulley and the crankshaft. A position sensor component such as a washer is interposed between the crankshaft and the drive pulley.

19 Claims, 8 Drawing Sheets

VALVE DRIVE MECHANISM FOR OUTBOARD MOTOR

RELATED APPLICATIONS

This application is based on Japanese Patent Application No. 11-262481, filed Sep. 16, 1999, the entire contents of which is hereby expressly incorporated by reference.

BACKGROUND OF THE INVENTION

1. Field of the Invention

The present invention generally relates to valve driving arrangements for outboard motors. More specifically, the present invention relates to an improved drive pulley mounting arrangement for such valve driving arrangements.

2. Related Art

Outboard motors are used to power watercraft through the water. The outboard motors are mounted to the transom or rear portion of the watercraft and provide a forward or reverse thrust. Because the outboard motor extends upward above a portion of the watercraft, the outboard motor is exposed to passing air streams caused by movement of the watercraft through water. Accordingly, the outboard motor can be a source of wind resistance or drag during movement through the water. This wind resistance results in decreased watercraft speeds or increased loading on the outboard motor.

Accordingly, it is desired to decrease the size of the exposed portion of the outboard motor. In some configurations, the outboard motor is decreased in a lateral direction while in other arrangements the outboard motor is decreased in a vertical direction. By designing a more compact engine that is housed within the outboard motor, the overall dimensions of the outer cowling can be decreased.

SUMMARY OF THE INVENTION

It has recently been determined that a mounting arrangement for a drive pulley of a cam drive arrangement could be improved. In particular, the drive pulley typically is mounted to a crankshaft of the engine using a nut that is threaded down over a portion of the crankshaft to engage a top of the drive pulley. This nut is threaded over a portion of the crankshaft having a large outside diameter. This large outside diameter is necessitated by the size of the crankshaft necessary to tolerate the loadings experienced by the crankshaft. The nut size is determined, at least in part, by the diameter of the member to which it is threaded. Accordingly, the nut can only be reduced in thickness to a certain degree. In addition, reducing the thickness of the nut decreases the number of threads that grip the corresponding threads on the crankshaft. Thus, the reduced nut size results in increased opportunity for loosening. Of course, this is a less than desirable solution to the problem of overall height of the engine and its associated components.

Accordingly, an improved mounting arrangement for the drive pulley is desired. Preferably, the mounting arrangement should positively fix the pulley to the crankshaft for rotation with the crankshaft. Moreover, the mounting arrangement should decrease the overall height of the engine and the associated components with the pulley mounted in place.

Accordingly, one aspect of the present invention involves an engine for an outboard motor. The engine comprises an engine case and a crankshaft extending through the case in a generally vertical direction. The crankshaft projects upwardly from the engine case and has a rotational axis. A drive pulley is mounted on the crankshaft and a flexible transmitter connects a driven pulley to the drive pulley. The driven pulley is mounted to a cam shaft and at least one fastener, which has center axis that extends generally parallel to the rotational axis of the crankshaft, joins the crankshaft and the drive pulley.

Another aspect of the present invention involves an engine comprising a generally vertically extending crankshaft. The crankshaft is journalled for rotation within an engine case. A bearing supports an upper end of the crankshaft within the engine case. The crankshaft has a first diameter and a second diameter. A face surface is defined at a transition between the first diameter and the second diameter. A drive pulley is mounted to the crankshaft with at least two fasteners. The face surface is disposed vertically above the bearing.

BRIEF DESCRIPTION OF THE DRAWINGS

These and other features, aspects and advantages of the present invention will now be described with reference to the drawings of a preferred embodiment, which embodiment is intended to illustrate and not to limit the invention, and in which figures.

DETAILED DESCRIPTION OF THE PREFERRED EMBODIMENTS OF THE INVENTION

Figure 1:
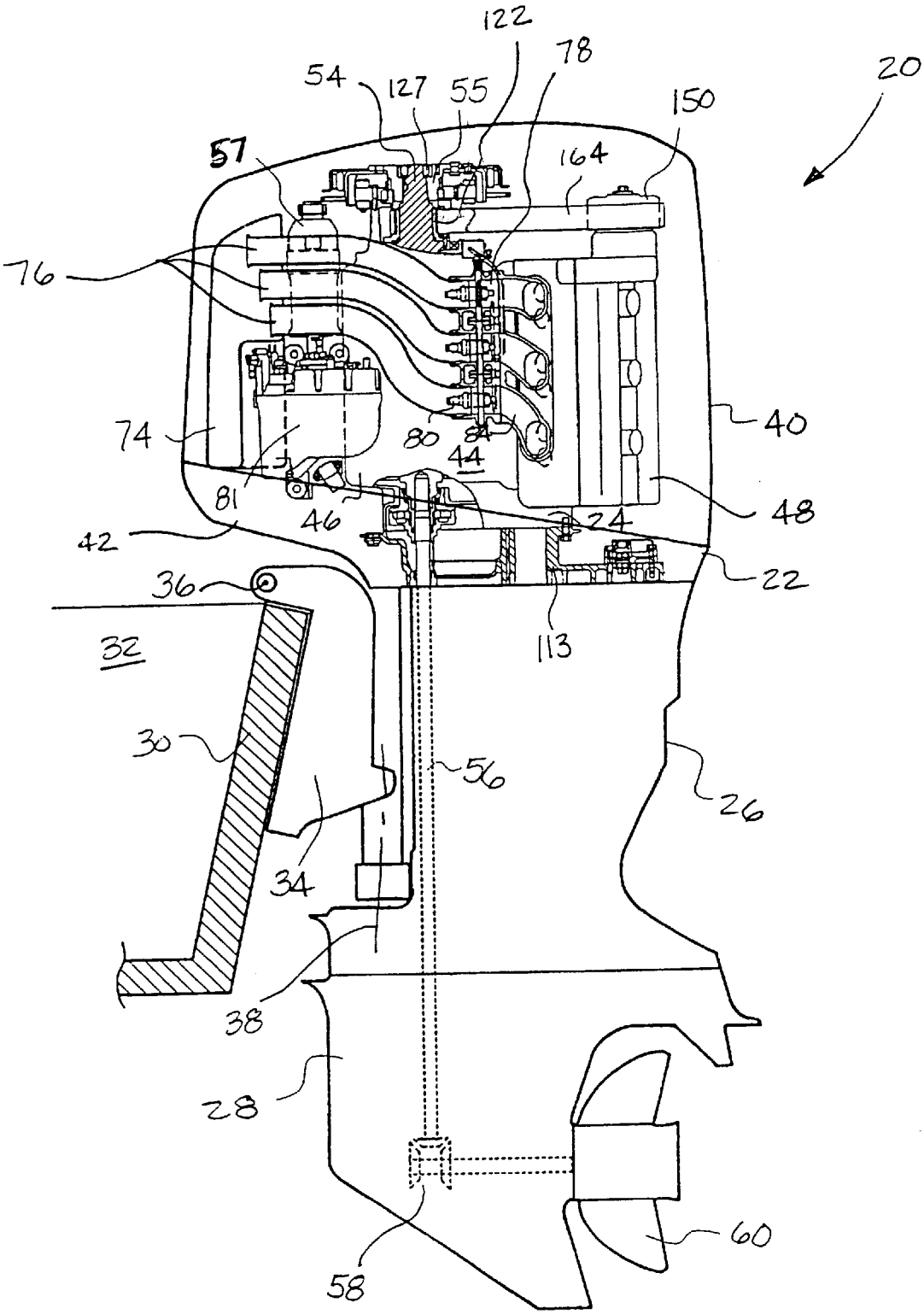
FIG. 1 is a side elevational view of an outboard motor attached to a transom of a watercraft. The outboard motor features an engine having a cam shaft drive arrangement configured and arranged in accordance with certain features, aspects and advantages of the present invention.

With reference now to FIG. 1, an outboard motor is illustrated therein. The outboard motor is generally indicated by the reference numeral 20. The outboard motor 20 desirably has a cam drive arrangement arranged and configured in accordance with certain features, aspects and advantages of the present invention. While the present invention will be described in the context of the outboard motor 20, it will be readily recognized by those of ordinary skill in the art that the present invention may also find utility in other engine applications. For instance, in applications where the engine size desirably is reduced, the present invention may find particular utility.

The outboard motor 20 generally comprises a protective cowling 22 that encases an internal combustion engine 24. The outboard motor 20 also comprises a driveshaft housing 26 and a lower unit 28. The protective cowling 22, the driveshaft housing 26 and the lower unit 28 combine to form an outer casing for the outboard motor 20. This outer casing is mounted to a transom 30 of a watercraft 32 powered by the outboard motor 20.

In the illustrated arrangement, the outboard motor 20 is connected to the transom 30 using a mounting bracket 34. The mounting bracket 34 generally comprises a generally horizontally disposed pivoting axis 36 that allows the outboard motor 20 to be tilted and trimmed relative to the watercraft 32. In addition, the mounting bracket 34 comprises a generally vertically extending axis 38 about which the outboard motor 20 may be steered relative to the watercraft 32. Any suitable mounting bracket 34 may be used to mount the outboard motor 20 to the watercraft 32.

With continued reference to FIG. 1, the upper cowling 22 preferably comprises an upper portion 40 and a lower portion 42. The upper portion 40 and the lower portion 42 preferably are removably attached to each other. In one arrangement, the two components 40, 42 may be pivotably connected to one another. In addition, the connection between the upper portion 40 and the lower portion 42 desirably is substantially watertight to reduce the likelihood of infiltration of water or other liquids into the engine compartment defined within the protective cowling 22.

Figure 2:
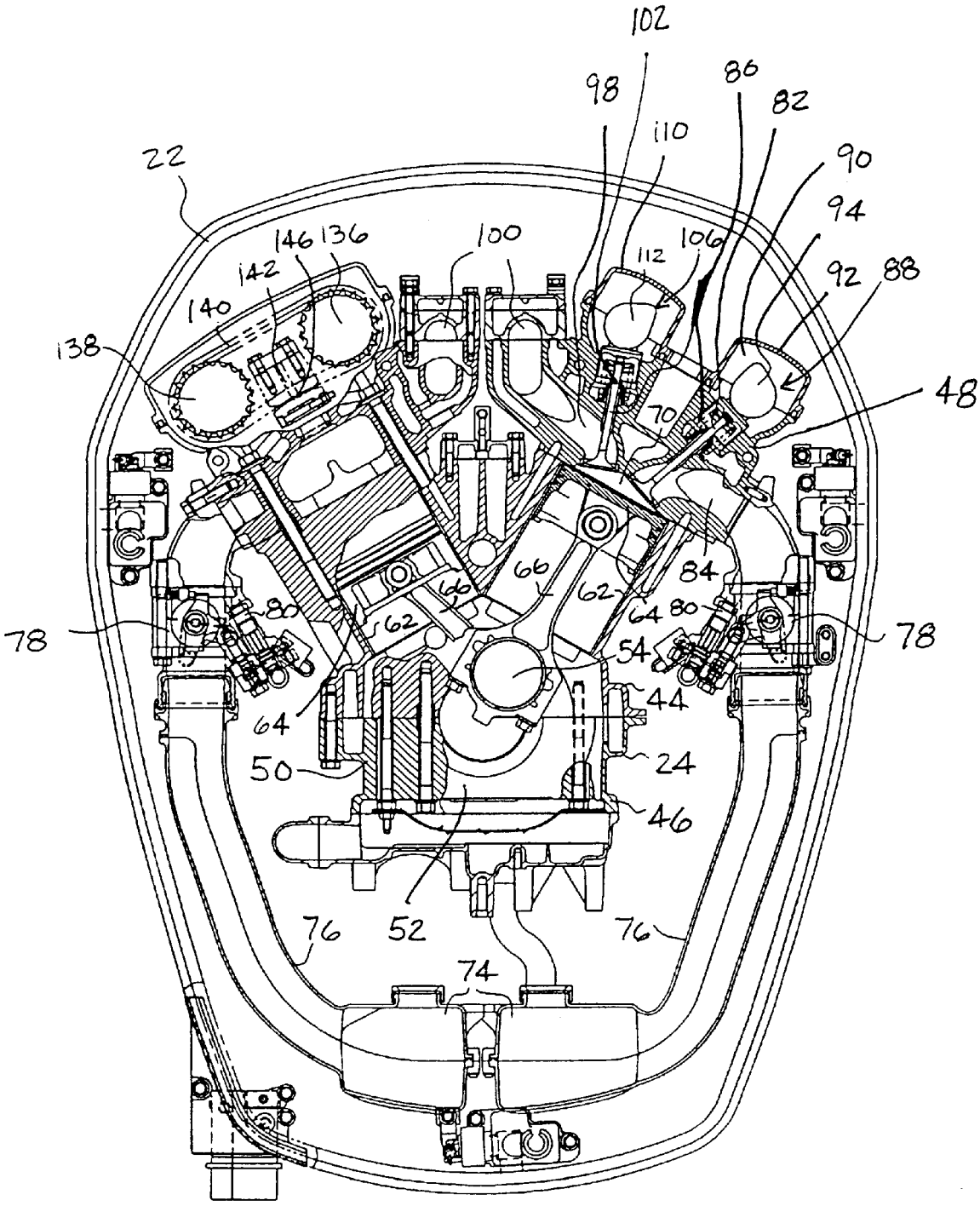
FIG. 2 is a top plan view of the outboard motor of FIG. 1 with the upper cowling removed and a portion of the engine illustrated in section.
Figure 3:
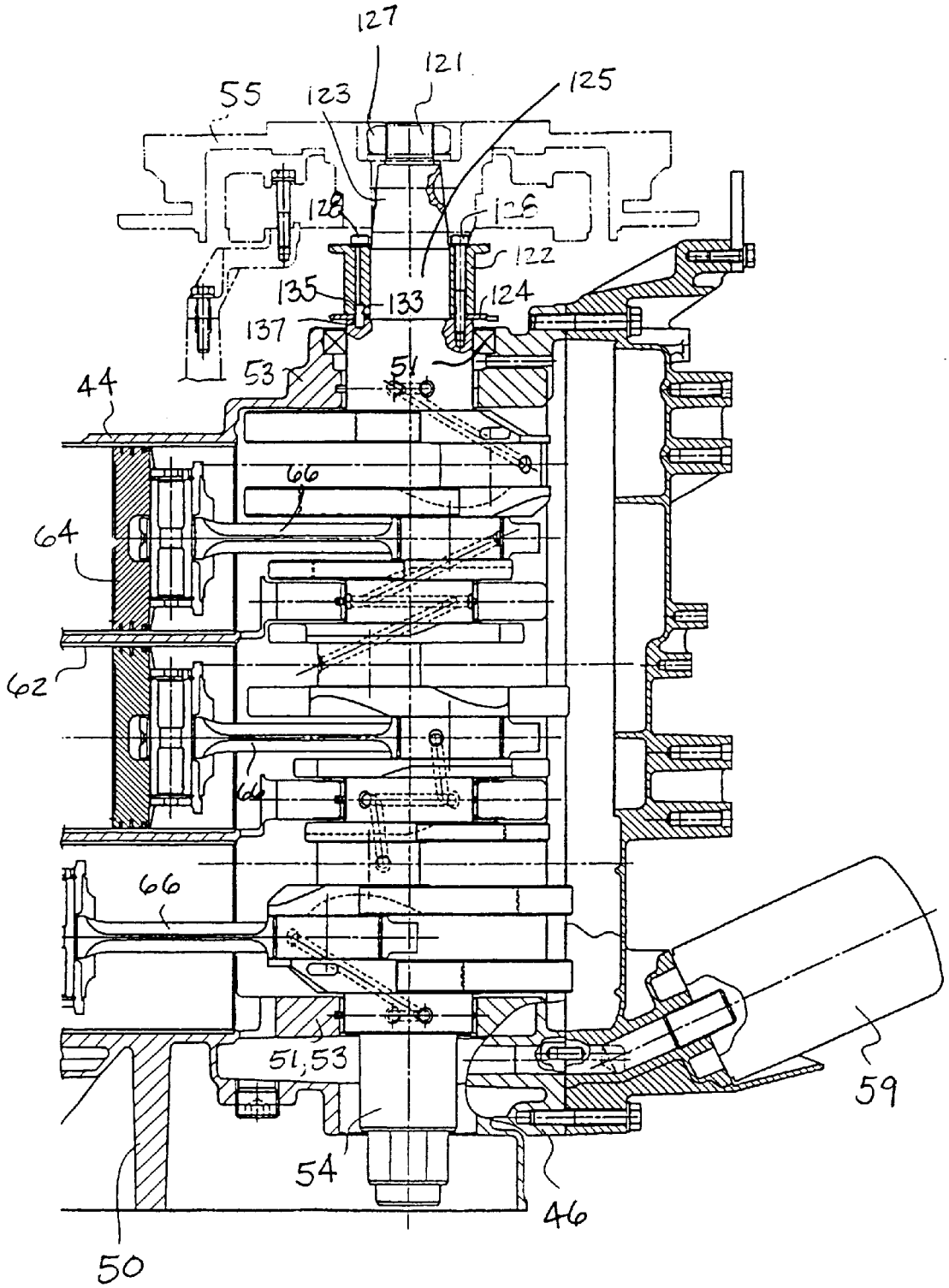
FIG. 3 is a sectioned view of the engine illustrating a drive pulley mounting arrangement arranged and configured in accordance with certain features, aspects and advantages of the present invention.

With reference now to FIGS. 1 and 2, the engine 24 of the outboard motor 20 will be described in more detail. Generally speaking, the engine 24 comprises a cylinder block 44, a crankcase cover 46 and a cylinder head 48. As is generally known, the cylinder block and the crankcase member 44, 46 are combined to form an engine case 50. These components can be attached in any suitable manner and together form a crankcase chamber 52. A crankshaft 54 is journaled for rotation within the crankcase chamber 52. Preferably, a pair of bearings 51 journal the crankshaft. In the illustrated arrangement, the bearings 51 are positioned within bosses 53 formed in the engine block 50. With reference to FIG. 3, the bearings 51 and the crankshaft preferably are lubricated by a lubrication system which include a filter 59.

In the illustrated arrangement, a flywheel 55 is attached to one end of the crankshaft and the crankshaft 54 is connected to a driveshaft 56 at the other end. Of course, in some arrangements, the flywheel 55 can be positioned at the end of the crankshaft that is connected to the driveshaft 56. It should be noted that a starter motor 57 can be positioned proximate the flywheel to engage a set of teeth formed on the flywheel during starting of the engine 24. The flywheel in the illustrated arrangement comprises a flywheel magneto, which has a rotor connected to the crankshaft and a stator fixed to a portion of the engine body.

The driveshaft 56 extends downward through the driveshaft housing 26 and terminates proximate a forward/neutral/reverse-type transmission 58. Of course, other suitable transmissions also may be used. The driveshaft 56 powers a propulsion unit 60 through the right angle transmission 58 in the illustrated arrangement. In the illustrated arrangement, the propulsion device 60 preferably is a propeller. In some arrangements, however, the propulsion device 60 may comprise a jet pump or any other suitable propulsion unit for an outboard motor or marine drive. In other applications, the driveshaft 56 may power other suitable propulsion devices 60 such as wheels, tracks or the like.

With reference now to FIG. 2, the cylinder head 48 is connected to the cylinder block 44. The cylinder block 44 may be formed within a single block of material or may comprise a number of individual cylinder bodies that are arranged side-by-side or in any other suitable configuration. It should be noted that while the present engine 24 comprises a V6 engine that operates on the four cycle operating principle, the engine may have any number of cylinders and may be arranged in any suitable configuration while operating on any suitable operating principle and still make use of a cam drive arrangement having certain features, aspects and advantages in accordance with the present invention.

The cylinder block 44 preferably comprises a number of cylinder bores 62. A set of pistons 64 are arranged for reciprocation within the cylinder bore 62 in mariners well known to those of skill in the art. The pistons 64 are connected to the crankshaft 54 using connecting rods 66. It should be noted that the crankshaft 54 has a power take off end and a flywheel end. Of course, the power take off end is the end connected to the drive shaft 56 and the flywheel end is the opposite end in the illustrated arrangement. Accordingly, the cylinder of each cylinder bank that is the closest to the power take off end can be called the power take off cylinder and the cylinder of each cylinder bank that is closest to the flywheel end can be called the flywheel cylinder. This arrangement is also well known to those of ordinary skill in the art.

The cylinder heads 48 preferably comprise a number of recesses 68 that are formed in alignment with the cylinder bores 62. The recesses 68, in combination with the cylinder bore 62 and the head of the piston 64, form combustion chambers 70. The combustion chambers 70 are variable volume combustion chambers such as those well known to those of ordinary skill in the art. Variable volume means the volume within the combustion chamber 70 changes with the reciprocation of the piston 64 within the cylinder bore 62. For instance as the piston 64 descends within the cylinder bore 62, the volume of the combustion chamber increases. Similarly, as the piston 64 rises within the cylinder bore 62 and approaches the cylinder head 48, the volume within the combustion chamber 70 decreases and the pressure rises.

The engine 24 also comprises an induction system 72. The induction system 72 can be formed in any suitable manner. In the illustrated arrangement, the induction system 72 comprises an air silencer 74. More particularly, in the illustrated arrangement, the engine 24 features a pair of air silencers 74 that are used to supply a fresh air charge from within the engine cowling 22 to each side of the engine 24 independently. Air is drawn into the cowling 22 through an air inlet opening (not shown). The air is then inducted into the air silencer 74 through a vacuum caused by the operation of the engine 24. Once inducted into the air silencer 74, the air travels through an air intake pipe 76 that is associated with each cylinder bank. In other words, the right cylinder bank has its own intake pipe 76 and air silencer 74 while the left cylinder bank also has its own intake pipe 76 and air silencer 74.

The air ingested into the air silencer 74 thus flows through the intake pipe 76 towards the combustion chambers 70. Between the combustion chambers 70 and the air silencer 74, a number of throttle bodies are disposed along each intake pipe 76. It should be noted that in the illustrated arrangement, three intake pipes 76 travel to three respective combustion chambers 70 and feature three corresponding throttle bodies 78. Of course, other arrangements also are possible.

As is generally known, the throttle body 78 comprises a throttle shaft and a throttle valve. The throttle valve rotates about the throttle shaft and controls the flow rate through the intake pipe 76 in accordance with the operator demand. The illustrated arrangement also features indirect injection. While the present invention is being illustrated with an engine featuring indirect injection, it should be recognized that the present invention may also be used with a directly injected engine and a carbuerated engine. In the illustrated arrangement, a set of fuel injectors 80 are disposed for injection into the induction system 72 at a point outside of the cylinder head 48. In particular, each fuel injector 80 is disposed proximate an associated throttle body 78 and preferably is mounted to the throttle body 78 in any suitable manner. Fuel is supplied to the fuel injectors 80 through a suitable fuel supply system that preferably includes a vapor separation tank 81.

Flow of the air fuel charge from the throttle body 78 into the combustion chambers 70 preferably is controlled by an intake valve 82. In the illustrated arrangement, a single intake valve is associated with each of the combustion chambers 70. It should be recognized, however, that certain features, aspects and advantages of the present invention may also be used in induction systems featuring more than one intake valve 82 per combustion chamber 70.

In the illustrated arrangement, the air fuel charge passes through an intake passage 84 under the control of the intake valve 82. The intake passage 84 is formed within the cylinder head 48 in any suitable manner.

The intake valve 82 preferably is biased by a spring 86 into a closed position. An intake cam shaft 88 is journaled for rotation within a cam chamber 90 in manner which will be described. The cam chamber 90 is formed by a cam cover 92 that forms a portion of the cylinder head 48.

The cam shaft 88 comprises a number of cam lobes 94. The cam lobes 94 have a suitable profile for driving the intake valves 82 to an open position at a particular timing to control the inflow of an air fuel charge into the combustion chamber 70. Typically, the cam lobe 94 depresses the intake valve 82 against the biasing force of the spring 86 to open the intake valve 82 from the seat formed in the cylinder head 48. The removal of the valve 82 from the seat allows the air fuel charge to flow into the combustion chamber 77, typically on a downstroke of the piston 64 within the cylinder bore 62. The exact timing of this intake process can vary.

The air fuel charge then is compressed within the combustion chamber 70 and is ignited by an ignition system (i.e., a spark from a sparkplug (not shown)). The sparkplug, however, typically is mounted within the cylinder head through a mounting bore 96 (see FIG. 5). After ignition, the air fuel charge is converted into exhaust gases. The exhaust gases desirably are removed from the combustion chamber 70 through a suitable exhaust system.

Figure 5:
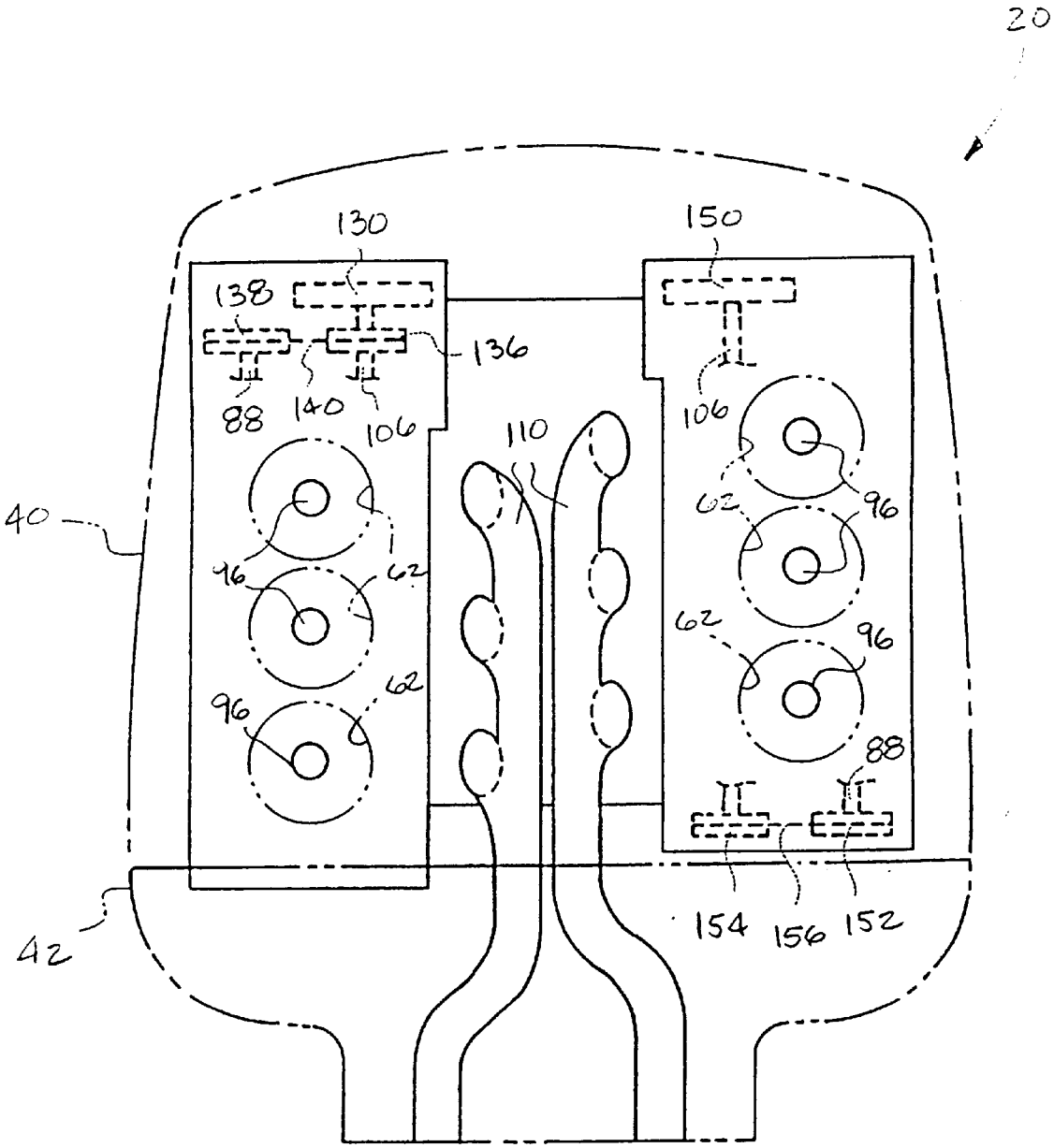
FIG. 5 is a rear elevation view of an outboard motor having an engine with a cam shaft drive arrangement arranged and configured in accordance for certain features, aspects and advantages of the present invention.

With reference now to FIGS. 2, 3 and 5, the exhaust gases preferably are removed from the combustion chamber via the exhaust system. The exhaust system in the illustrated arrangement comprises an exhaust passage formed within the cylinder head 48. The exhaust passage is indicated by the reference numeral 98. As will be understood, each cylinder comprises at least one, if not more than one, exhaust passage extending from the cylinder head toward an exhaust manifold 100. Flow through the exhaust passage 98 from the combustion chamber 70 desirably is controlled by an exhaust valve 102. The exhaust valve 102, similar to the intake valve 82, includes a spring 104 that biases the exhaust valve 102 into a closed position in the illustrated arrangement. An exhaust cam shaft 106 preferably is disposed within an exhaust cam chamber 108 that is formed by the cylinder head 48 and the cam cover 110.

Similar to the intake cam shaft 88, the exhaust cam shaft 106 comprises a number of cam lobes 112. The cam lobes are sized and configured to displace the exhaust valve 102 and allow exhaust gases to pass into the exhaust passage 98.

With reference now to FIG. 5, the exhaust gases pass from the exhaust passage 98 into the exhaust manifold 110 through a plurality of runners. The exhaust manifold 110 further cooperates with passages formed within the drive-shaft housing 26 and other components. In some applications, the exhaust manifold 100 extends downward to a passage formed within an exhaust gas guide plate 113 upon which the engine is mounted. The exhaust gas is then passed downward into an expansion chamber and then out a through-the-hub underwater discharge or an above-the-water low speed discharge. Because these arrangements are well known to those of skill in the art, further description is not necessary.

Figure 4:
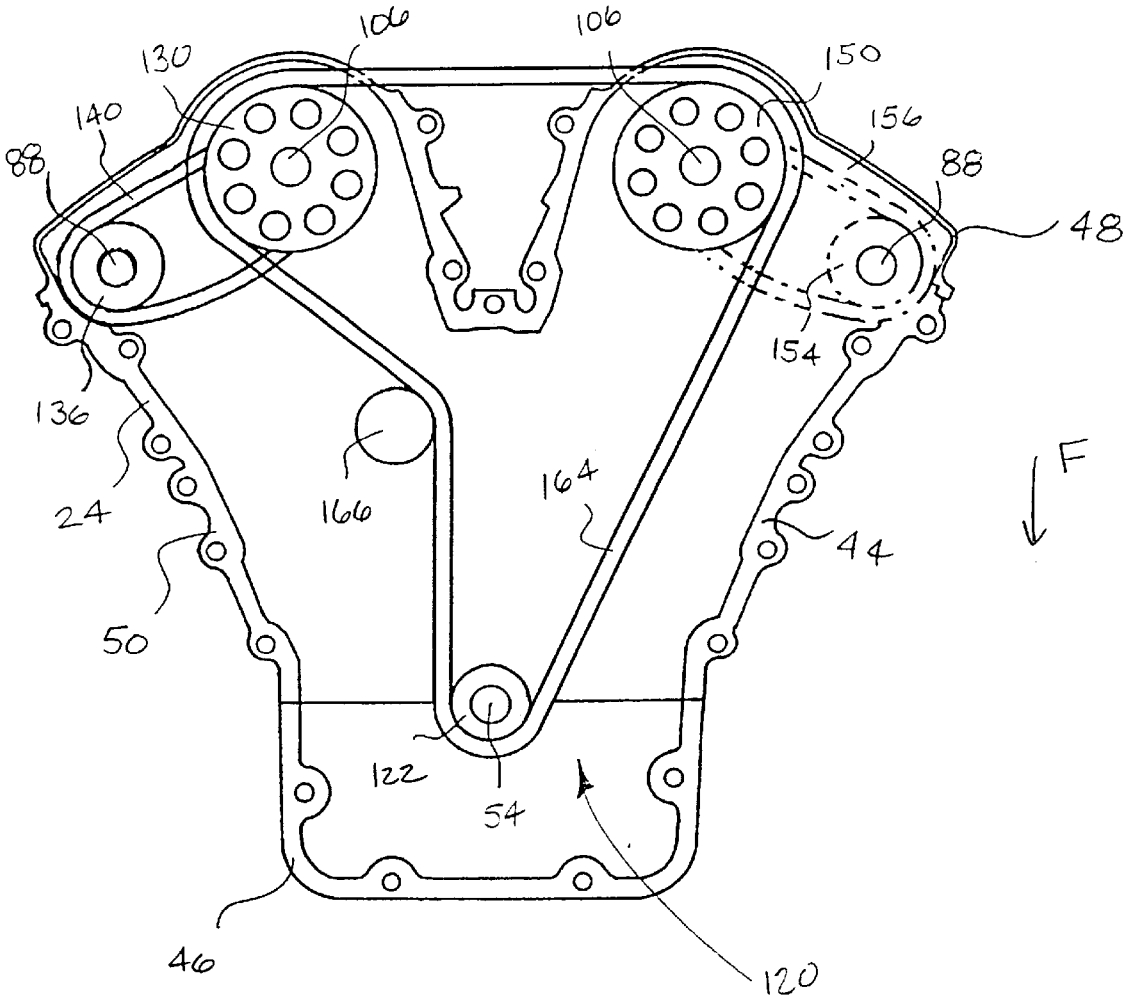
FIG. 4 is a simplified top plan view of a cam shaft drive arrangement having certain features, aspects and advantages in accordance with the present invention.

The intake valves 82 and the exhaust valves 102 are driven by the intake cam shaft 88 and the exhaust cam shaft 106. A driving arrangement for these shafts 88, 106 will now be described with reference to FIGS. 4–8. With reference now to FIG. 4, a simplified top view of the drive arrangement 120 is illustrated therein. As illustrated, a portion of the crankshaft 54 is used to carry a drive pulley 122.

Figure 8:
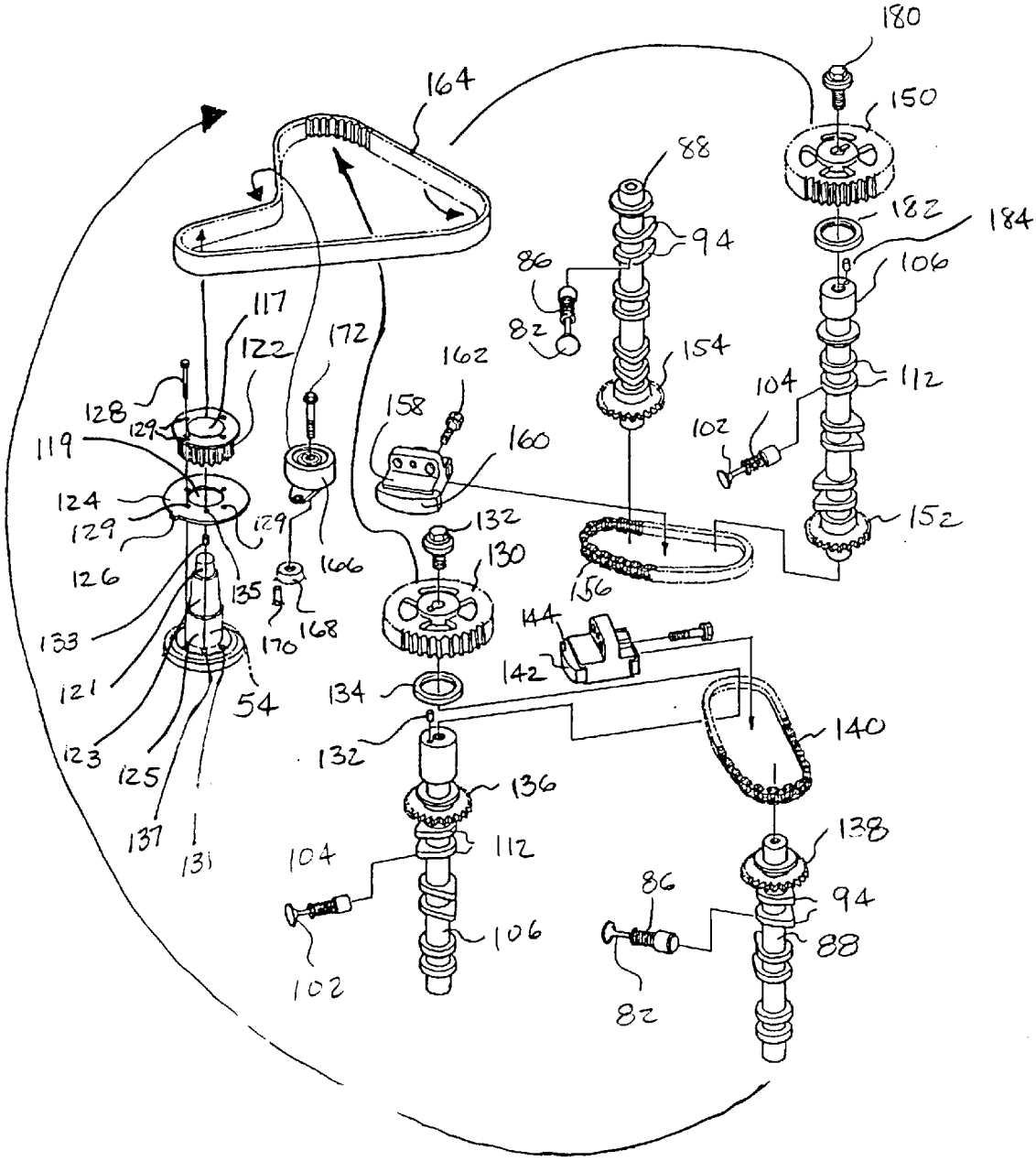
FIG. 8 is an exploded perspective view of the main components of the cam drive arrangement illustrated in FIGS. 1–7.

With reference to FIG. 8, an upper portion of the crankshaft 54 has a first stepped portion 121, a second stepped portion 123 and a third stepped portion. The first stepped portion preferably is threaded and receives a nut 127. The nut 127 can be tightened into a recess formed within the flywheel 55. Accordingly, the flywheel 55 preferably is mounted on the second stepped portion 123. The third stepped portion 125 advantageously carries the drive pulley 122 and extends through an opening 117 formed in the drive pulley. Preferably, the drive pulley 122 is cylindrical in nature with the opening 117 centered on the rotational axis of the pulley 122.

In addition, the third stepped portion 125 preferably receives a position detecting washer 124. Accordingly, the third stepped portion 125 extends through an opening 119 formed in the position detecting washer 124. The position detecting washer 124 preferably contains a position indicating tab 126 or another suitable position identifying mechanism that cooperates with a sensing or sending unit to allow the engine's CPU or controller to identify the relative positioning of the crankshaft within its 720° cycle.

In the illustrated arrangement, both the drive pulley 122 and the position detecting washer 124 contain a plurality of holes 129 that receive bolts 128. The bolts 128 or other threaded fasteners secure the drive pulley 122 and the position detecting washer 124 to the crankshaft 54 by threading into blind threaded holes 131 formed in the end of the crankshaft 54 adjacent to the third stepped portion 125. In this manner, both the washer and the pulley 124, 122 rotate with the crankshaft 54. To further secure the washer 124 and the pulley 122 to the crankshaft, a pin 133 extends through holes 135 formed in both members and is secured in a blind hole 137 formed within the crankshaft. The hole 135 formed in the drive pulley 122 preferably is a blind hole.

With reference again to FIG. 4, the right cylinder bank in the illustrated arrangement contains a driven exhaust cam shaft 106. The exhaust cam shaft 106 is driven by a driven pulley 130. With reference again to FIG. 8, a threaded fastener 132 attaches the driven pulley 130 to the cam shaft 106. As described above, the cam shaft 106 contains a number of cam lobes 112 that are used to actuate the exhaust valves 102. An end of the cam shaft 106 includes an aperture that receives a positioning pin 132. The positioning pin orients the driven pulley 130 in a desired orientation as well as reduces the likelihood of relative spinning between the driven pulley 130 and the cam shaft 106. In addition, a seal 134 is disposed between the driven pulley 130 and the cam shaft 106.

The cam shaft 106 also includes a coupling sprocket 136. The coupling sprocket 136 drives the intake cam shaft 88. Specifically, in the illustrated arrangement, the intake cam shaft 88 includes a second coupling sprocket 138 that is connected to the first coupling sprocket 136 with a chain 140. While in the illustrated arrangement, a chain drive is used, other driving arrangements also can be used, such as gear trains and belt drives. The chain drive, however, advantageously maintains the 1:1 ratio between the two cam shafts 88, 106. In the illustrated arrangement, the chain 140 is tensioned with a guide 142. The guide 142 includes a slide plate 144 over which the chain 140 slips. With the guide 142, the chain can be tensioned such that the likelihood of the chain 140 disengaging from either of the sprockets 136, 138 is reduced. With reference to FIG. 3, the guide 142 is secured to a mounting boss 146 formed in the cylinder head. Of course, other mounting arrangements also can be used depending upon the application.

With reference again to FIGS. 4 and 5, the other cylinder bank also includes a drive arrangement that is similar to that of the first cylinder bank in some respects. More particularly, in this arrangement, the exhaust cam shaft 106 is driven with a drive pulley 150. In this arrangement, however, the driven pulley 150 is positioned at one end of the exhaust cam shaft 106 while a driven sprocket 152 is disposed at the opposite end of the cam shaft. The first sprocket 152 drives a second sprocket 154 which is disposed at the lower end of the intake cam shaft 88. The first and second sprockets 152, 154 are connected together by a chain 156 which can also be biased by a guide plate 158. A guide plate may comprise a wear plate 160 and preferably is attached to a mounting boss with a threaded fastener 162.

With reference again to FIG. 4, a belt 164 preferably connects the drive pulley 122 to the driven pulleys 130, 150. The belt 164 can be tensioned through a tensioning roller 166. With reference again to FIG. 8, the tensioning roller 166 preferably is connected to a mounting boss 168 and a location pin 170. In the illustrated arrangement, a threaded fastener 172 is used to connect the idler roller 166 to the engine block. Of course, other suitable mounting arrangements can also be used.

With reference still to FIG. 8, preferably the driven pulley 150 is secured to an upper end of the exhaust cam shaft 106 using a threaded fastener 180. A seal 182 desirably is interposed between the driven pulley 150 and the cam shaft 106. In addition, a positioning pin 184,is used to position the pulley 150 in an appropriate orientation and to maintain the orientation of the pulley 150 relative to the cam shaft 106.

Figure 6:
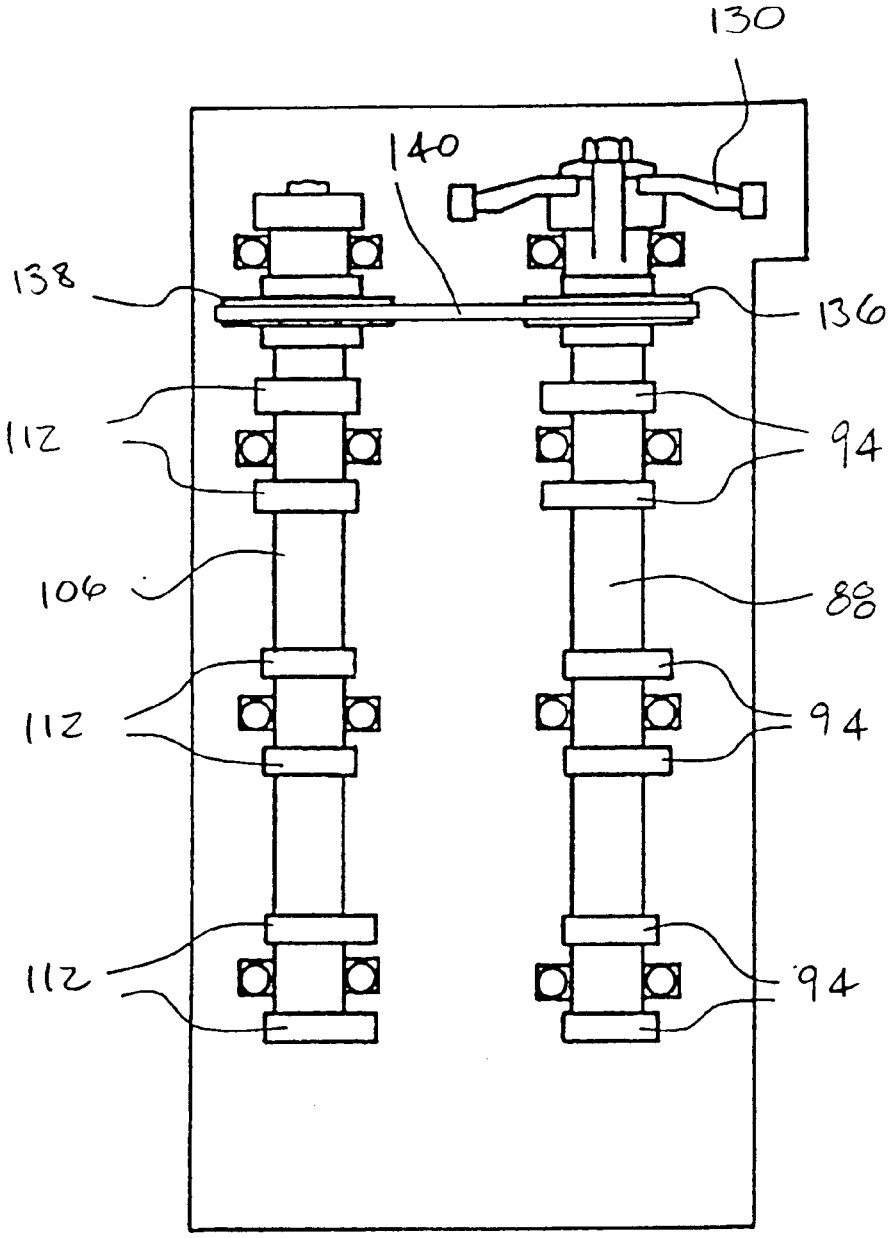
FIG. 6 is a rear elevation view of a portion of the cam drive arrangement associated with a single cylinder bank of the engine.
Figure 7:
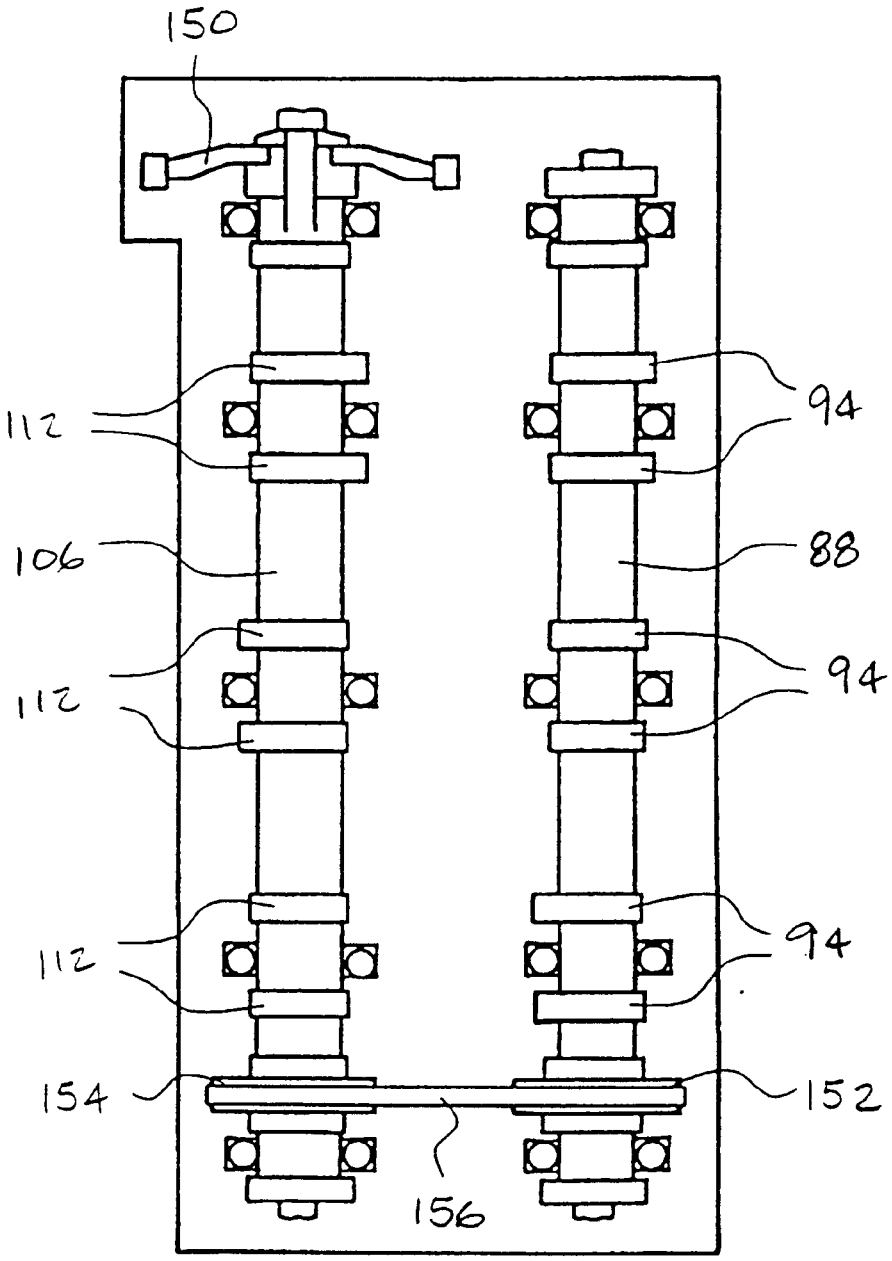
FIG. 7 is another simplified rear elevation view of a cam shaft drive arrangement for the other cylinder bank.

With reference now to FIG. 6, it can be seen that in one cylinder bank, particularly that in which the cylinders lie on a lower location, the drive arrangement between the two cam shafts is positioned at the upper end of the cam shafts 88, 106. With reference now to FIG. 7, it can be seen that in the cylinder bank having the cylinders positioned at a higher location, the interlocking drive arrangement between the cam shafts is preferably disposed at a lower location. In other words, on the cylinder bank having the higher relative positioning for the cylinders, the interlocking drive arrangement is on the bottom of the shafts.

The sprockets 152, 154 preferably are positioned at the bottom end or near the bottom end of the cam shafts 88, 106. This arrangement takes advantage of the relative positionings of the cylinders within the two respective banks. Accordingly, the placement makes use of generally dead space or unused space within the engine compartment thereby allowing the engine to have a smaller relative vertical dimension while maintaining the relatively narrow girth sought after by the offset cylinder arrangement. In addition, this configuration allows the driven pulleys 130, 150 to remain in the same plane while better accommodating the connection between the two shafts (i.e., the sprocket and chain connection). It should be noted that, in some arrangements, the intake cam shafts are directly driven by the crankshaft and, in other arrangements, one intake cam shaft is driven and one exhaust cam shaft is driven.

Although the present invention has been described in terms of a certain embodiment, other embodiments apparent to those of ordinary skill in the art also are within the scope of this invention. Thus, various changes and modifications may be made without departing from the spirit and scope of the invention. For instance, various components may be repositioned as desired. Moreover, not all of the features, aspects and advantages are necessarily required to practice the present invention. Accordingly, the scope of the present invention is intended to be defined only by the claims that follow.

What is claimed is:

1. An engine for an outboard motor, said engine comprising an engine case, a crankshaft extending through said case in a generally vertical direction, said crankshaft projecting upwardly from said engine case and having a rotational axis, said crankshaft having a stepped configuration defined by a reduced diameter portion, said crankshaft also having a surface that is generally normal to said rotational axis and that abuts said reduced diameter portion, a drive pulley mounted on said crankshaft on said reduced diameter portion, a flexible transmitter connecting a driven pulley to said drive pulley, the driven pulley being mounted to a cam shaft, and a plurality of fasteners joining said drive pulley to said crankshaft, each of said plurality of fasteners having a center axis that extends generally parallel to said rotational axis of said crankshaft and extending into a blind hole having an opening on said surface.

2. The engine of claim 1 further comprising a pin that is interposed between said drive pulley and said crankshaft.

3. The engine of claim 1, wherein said surface contains a pin-receiving hole.

4. The engine of claim 3 further comprising a position sensor mounted to said crankshaft.

5. The engine of claim 4 wherein said position sensor comprises a position detecting washer.

6. The engine of claim 1 further comprising a flywheel mounted to said crankshaft and said drive pulley being mounted between said flywheel and said engine case.

7. An engine comprising an engine case, a generally vertically extending crankshaft journalled for rotation within said engine case, a bearing supporting a portion of said crankshaft within said engine case, said crankshaft having an upper end extending beyond said engine case, said upper end of said crankshaft defining a first diameter and a second diameter, a face surface being defined at a transition between said first diameter and said second diameter, a drive pulley mounted to said crankshaft, and a plurality of fasteners, each comprising an external thread and extending into said face surface to affix said drive pulley to said face surface.

8. The engine of claim 7 further comprising a position detector mounted to said crankshaft.

9. The engine of claim 8, wherein said position detector comprises a position detecting washer.

10. The engine of claim 7 further comprising a pin that is interposed between said drive pulley and said crankshaft.

11. The engine of claim 10, wherein said pin extends into said face surface.

12. The engine of claim 7 further comprising a flywheel magneto that is disposed vertically above said drive pulley.

13. The engine of claim 12, wherein said flywheel magneto comprises a rotor and a stator, and said at least one fastener and said drive pulley are disposed generally below said stator.

14. The engine of claim 7, wherein said first diameter extends at least from said bearing to an outer edge of said face surface.

15. The engine of claim 1, wherein each one of said plurality of fasteners has a center axis that extends generally parallel to said rotational axis.

16. An engine comprising an engine case, a crankshaft being journalled for rotation within the engine case, the crankshaft having an end portion extending beyond the engine case, the end portion having a first diameter and a second diameter together defining a step area therebetween, the step area extending generally normal to a rotational axis of the crankshaft and having at least one blind hole extending generally parallel to and offset from the rotational axis of the crankshaft, a drive pulley abutting on the step area and extending coaxially with the crankshaft, and at least one threaded fastener extending downward through the drive pulley to terminate within the blind hole.

17. The engine of claim 16 additionally comprising a washer interposed between the step area and the drive pulley, and the washer defining a portion of a position detector that detects an angular position of the crankshaft.

18. The engine of claim 16 additionally comprising a flywheel magneto disposed opposite from the step area relative to the drive pulley.

19. The engine of claim 16, wherein the engine comprises a plurality of the fasteners.

* * * * *